United States Patent [19]

Osborn

[11] Patent Number: 4,778,283

[45] Date of Patent: Oct. 18, 1988

[54] DRAW BAND BAG

[75] Inventor: Paul V. Osborn, Webster, N.Y.

[73] Assignee: Mobil Oil Corporation, New York, N.Y.

[21] Appl. No.: 947,717

[22] Filed: Dec. 30, 1986

[51] Int. Cl.[4] ..... B65D 33/16; B65D 33/28

[52] U.S. Cl. ..... 383/71; 383/72; 383/76; 383/77

[58] Field of Search ..... 383/71, 72, 76, 77, 383/79

[56] References Cited

U.S. PATENT DOCUMENTS

| | | | |
|---|---|---|---|
| 3,029,853 | 11/1959 | Piazze | 383/75 |
| 3,285,309 | 11/1966 | Northcott | 383/76 |
| 3,414,032 | 3/1967 | Jortikka | 383/76 |
| 3,738,568 | 6/1973 | Ruda | 383/75 |
| 3,865,303 | 2/1975 | Korn | 383/76 |
| 3,982,687 | 9/1976 | Auer et al. | 383/77 |
| 4,558,463 | 12/1985 | Boyd | 383/75 |

*Primary Examiner*—Willis Little

*Attorney, Agent, or Firm*—Alexander J. McKillop; Michael G. Gilman; Charles J. Speciale

[57] ABSTRACT

A draw band bag made from polyethylene film providing a bag body having side seals and a mouth at one end of the body defined by a lip portion. A draw band extends along the lip portion of the bag and is secured at the opposite ends to the side seals of the bag. The body has an opening therethrough adjacent the lip portion and intermediate the side seals through which the draw band is adapted to be pulled for closing the mouth. The draw band covers the openings through the bag body prior to being pulled therethrough. After the draw band is pulled through the openings to close the mouth, it is used to make a half hitch around the top of the bag and pulled tight.

3 Claims, 3 Drawing Sheets

DRAW BAND BAG

BACKGROUND OF THE INVENTION

This invention relates to plastic draw band bags and more particularly, to hemless draw band bags having a tight closure.

Bags made of plastic film such as thin polyethylene film have been used in various sizes. Small bags are used in the packaging of sandwiches and the like; larger bags are used as shopping bags and even larger bags are used for containing trash. The present invention is particularly related to the small or medium size bags where the loading the bag is not particularly heavy.

A particularly advantageous closure for such bags includes a draw band or tape constructed from the same polyethylene material. U.S. Pat. No. 3,029,583—Piazzi and U.S. Pat. No. 3,414,032—Jortikka are examples of draw tape bags of the moderate size shopping bag type. U.S. Pat. No. 3,738,568—Ruda discloses a plastic bag with a draw band separably integral with the bag body and U.S. Pat. No. 4,558,463—Boyd discloses a hem seal for a draw tape trash bag. All of these patents disclose plastic bags having hems that are heat sealed wherein the hems contain the draw tape. Other types of small bag closures not requiring hems have been used in the prior art including the twist tie, zip lock, handle ties, folded over flap and glued flap. The draw tape bags of the present invention have a cost advantage over all of the foregoing types of bag closures with the exception of the twist tie type. With respect to the twist type closure, the draw tape bags of the present invention have the advantage that the draw tape closure is ready for use in that it forms an integral part of the bag. The draw tape bags of the present invention also have the advantage with respect to the bags of the handle tie, folded over flap and glued flap types in that the bags of the present invention provide a tight closure.

It is an object of the present invention to provide a hemless draw band bag which is economical to manufacture and where the draw band is secured to the bag and available for use in providing a tight closure for the bag.

SUMMARY OF THE INVENTION

In accordance with the present invention, there is provided a draw band bag made from pliable sheet material having a bag body having side seals and a mouth at one end of the body defined by a lip portion. A draw band extends along the lip portion of the bag and is secured at the opposite ends thereof to the side seals of the bag. The bag body has an opening through the bag body adjacent the lip portion and intermediate the side seals of the bag through which the draw band is adapted to be pulled for closing the mouth. The draw band covers the opening through the bag body prior to being pulled therethrough for closing the mouth. In one embodiment of the invention the draw band comprises a folded over double-ply portion of the bag body partially separated from the body with relatively minute tear points connecting it to the body.

Further in accordance with the invention there is provided a method of making a draw band bag comprising the steps of extruding a tube of polyethylene which is oriented in the extruded direction and slitting one side of the tube to form two panels and an open top for the bag. The method includes cutting openings through both of the panels adjacent the open top thereof and intermediate the sides of the panels and placing a draw tape parallel to the open top of the bag and over the openings in the panels. The method also includes heat sealing the sides of the panels and the opposite ends of the draw tape thereto whereby the open top of the bag is pulled closed when the draw tape is pulled through the openings in the panels. In accordance with a further aspect of the method of the present invention the top of the bag is slit off and repositioned so that it will be sealed to the rest of the bag when the side seals of the bag are formed. The slit material forms the draw band for the bag. The material slit off from the top of the bag is left attached to the top of the bag by weak perforations thus controlling the position of the draw band until it is used to close the bag.

The foregoing and other objects features and advantages of the invention will be better understood from the following more detailed description and appended claims.

SHORT DESCRIPTION OF THE DRAWINGS

DESCRIPTION OF THE PREFERRED EMBODIMENT

The plastic draw band bags of the present invention may be made from either high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463 referred to above.

Figure 1:
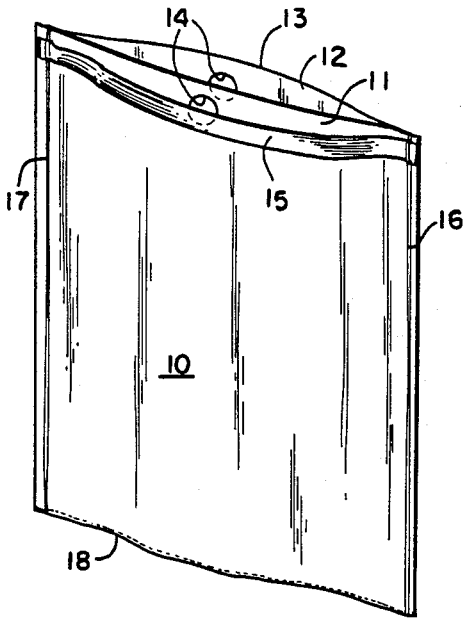
FIG. 1 is a perspective view of a draw band bag embodying the present invention.

Referring now to FIG. 1, a draw band bag 10 according to the present invention includes a front panel 11 and a rear panel 12. The two panels are formed from a tube of polyethylene which is oriented in the direction of extrusion. The sides of the panels are cut from the tube in a perpendicular direction. The tube is slit along the top 13 to form an open top in the bag for reception of articles. Holes 14 are punched in both of the panels 11 and 12 of the bag adjacent to the top 13 and spaced therefrom a predetermined distance. A draw tape or band 15 is positioned on the outer surface of panel 11 parallel to the top 13 and over the holes 14. The ends of the draw band 15 are secured to the opposite sides of the bag 10 when the side heat seals 16 and 17 are made. The bottom 18 of the bag 10 is formed by the fold joining the front and back panels 11 and 12. As may be seen in FIG. 1 the holes 14 in the panels of the bag have about the same diameter as the width of the tape 15 and the holes 14 are punched through both layers of the bag in the middle of the bag at the same distance from the top of the bag as the band 15.

Figure 2:
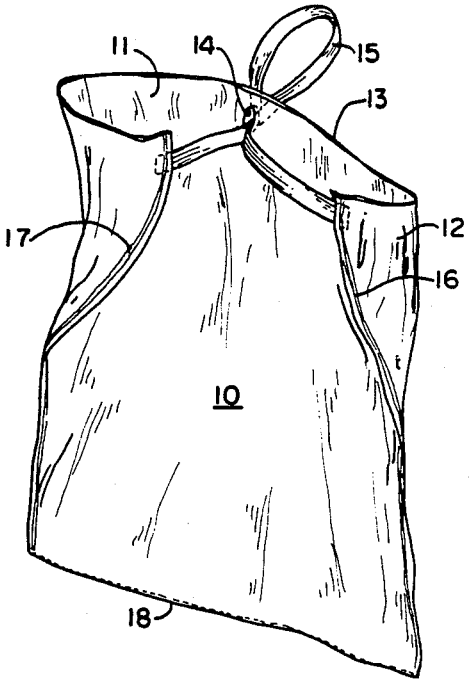
FIGS. 2–4 are perspective views of the method of closing the open mouth of the draw band bag so as to form a tight, leakproof closure.
Figure 3:
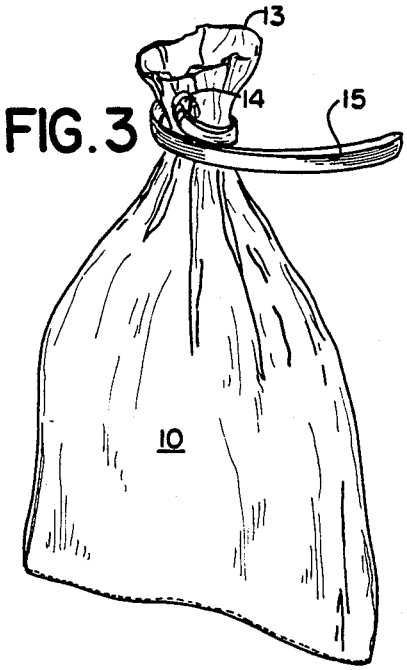
Figure 4:
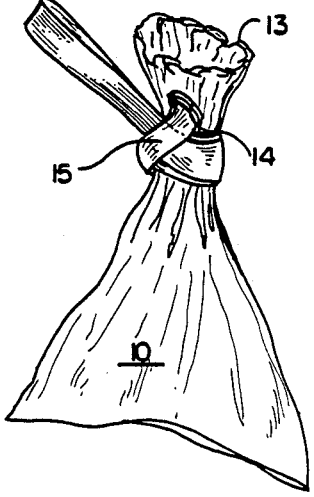
Figure 5:
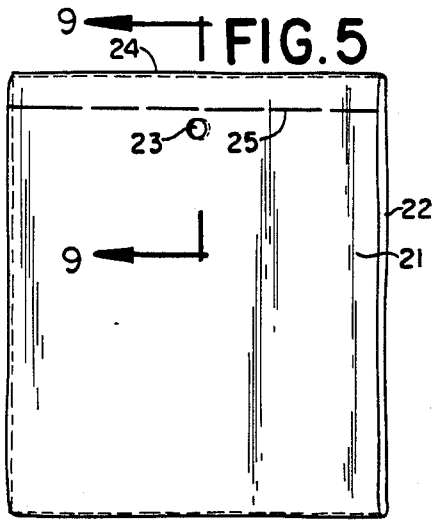
FIGS. 5–8 are perspective views illustrating the steps of the process of manufacturing a modification of the new draw band bags.
Figure 6:
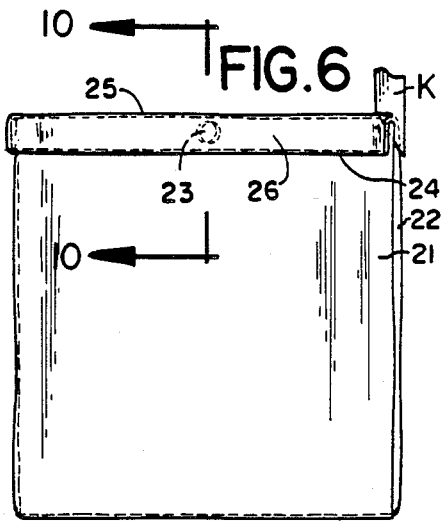
Figure 7:
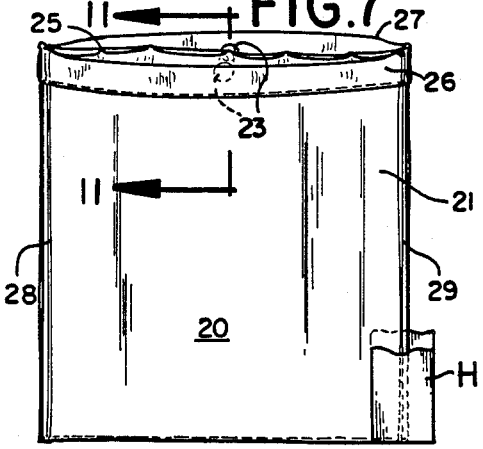

Referring to FIGS. 2–4, closure of the bag is effected by inserting the middle of the band 15 as a loop through the holes 14 in both panels 11 and 12 and pulling in the top corners of the bag 10 to the holes 14 at the center of the panels. A tight, leak proof closure is formed when the double tape 15 on the side of the bag 10 opposite from the pulled in corners, FIG. 2, is used to make a half hitch around the top 13 of the bag and pulled tight, FIGS. 3 and 4.

Referring to FIGS. 5–13 there is illustrated a modification of the draw band bag incorporating the present invention. An extruded tube of polyethylene film is flattened to form a web having two layers joined at the top and bottom thereof. A section of the web is cut off in a perpendicular direction corresponding in length to the width of the bag to form the front and rear panels 21 and 22 for the bag FIGS. 5 and 9. Holes 23 are punched through both of the panels 21 and 22 at a location adjacent the top edge 24 of the panels and intermediate the side edges thereof. The panels 21 and 22 are perforated along a line 25 parallel to the top thereof and intermediate the top 24 and the holes 23 in the panels. The top portions of the panels 21 and 22 are folded over at the perforations 25 to form a band 26, FIGS. 6 and 10, to cover the holes 23 through the panels 21 and 22. The perforations 25 in the rear panel 22 are slit, for example by a knife K, FIG. 6, as to form an open top 29 for the bag 20, FIGS. 7 and 11. The side edges of the panels 21 and 22 are heat sealed to each other along the seal lines 28, 29 and to the ends of the draw band 26 by a conventional heat sealer H, FIG. 7. The draw band 26 is maintained in position over the holes 23 in the panels 21, 22 by the perforations 25 in the front panel 21 prior to closing the open top 27 of the bag 20.

Figure 8:
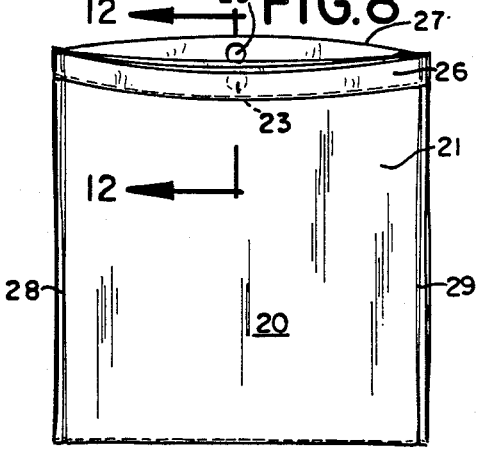
Figure 13:
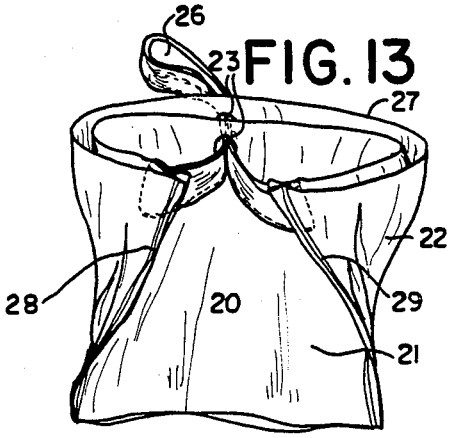
FIG. 13 is a perspective view illustrating the method of closing the open top of the bag illustrated in FIG. 8.
Figure 9:
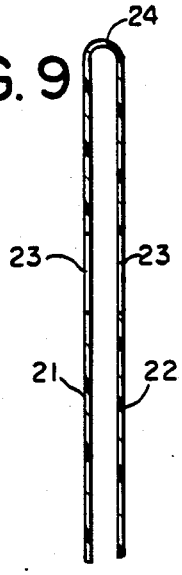
FIGS. 9–12 are enlarged fractional cross sections taken along the lines 9—9, 10—10, 11—11 and 12—12 of FIGS. 5–8 respectively.
Figure 10:
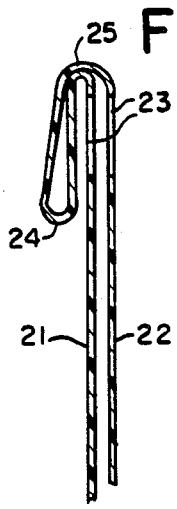
Figure 11:
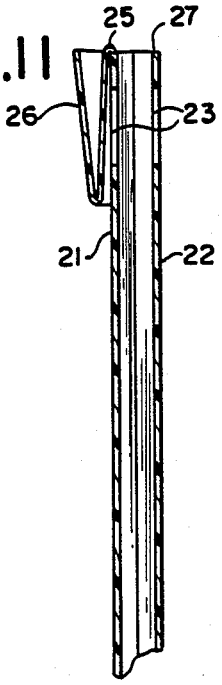
Figure 12:
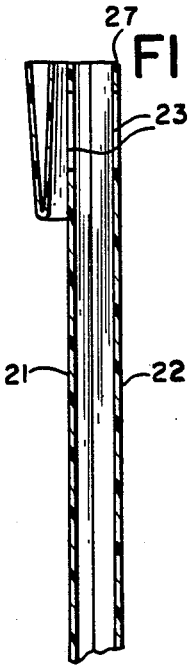

When the bag 20 has been filled and it is ready to be closed, the draw band 26 is pulled away from the front panel 21 of the bag to break the perforations 25 which attach it thereto. This is best shown in FIGS. 8 and 12. Closure of the bag 20 is effected in the same manner as previously described in connection with the draw band bag 10 illustrated in FIGS. 1–4. As shown in FIG. 13, closure of the bag 20 is effected by inserting the middle of the band 26 as a loop through the holes 23 in both panels 21 and 22 and pulling in the top corners of the bag 20 to the holes 23 at the center of the panels. A tight, leakproof closure is formed when the double band 26 on the side of the bag 20 opposite form the pulled in corners is used to make a half hitch around the top of the bag and pulled tight similar to the manner illustrated in FIGS. 3 and 4 with respect to bag 10.

It is to be understood that the invention may be carried out for making bags of material other than the specific ones mentioned above. While there has been described a preferred embodiment of the invention, it will be understood that further modifications may be made without departing from the spirit and scope of the invention as set forth in the appended claims.

What is claimed is:

1. A draw band bag made from pliable sheet material providing a bag body having side seals and a mouth at one end of the body defined by a lip portion, a draw band extending along the lip portion of said bag and secured at the opposite ends thereof to the side seals of said bag, and said body having an opening through said bag body adjacent the lip portion and intermediate the side seal of said bag through which the draw band is adapted to be pulled for closing said mouth, wherein said draw band covers the opening through said bag body prior to being pulled therethrough for closing said mouth, and wherein said draw band comprises a folded over double-ply portion of the bag body including an inner ply and an outer ply, the outer ply of said draw band being separated from said body to provide an open mouth and the inner ply of said draw band being partially separated from said body with relatively minute tear points connecting it to the body.

2. A draw band bag made from pliable sheet material providing a bag body having side seals and a mouth at one end of the body defined by a lip portion, said body having an integral double-ply portion thereof folded over at said lip portion and partially separated from said bag body with relatively minute tear points connecting it by only one ply to the body along said lip portion and providing a folded over double-ply flat draw band, said bag body having a pair of openings therein through which the draw band is adapted to be pulled for closing said mouth, said draw band being sealed at its ends to the side seals of said bag body.

3. A method of making a draw band bag comprising extruding a tube of plastic film, flattening the tube to form a web having two layers joined at the top and bottom thereof, cutting off a section of the web corresponding in length to the width of the bag to form front and rear panels for the bag, punching a hole through both of the panels at a location adjacent the top edge of the panels and intermediate the side edges thereof, perforating both of the panels along a line parallel to the top thereof and intermediate the top and the holes in the panels, folding over the top portion of both of the panels at the perforated line to form a double-ply band to cover the holes through the panels, slitting the perforations in the rear panel of the bag so as to form an open top for the bag, and sealing the side edges of the panels to each other and to the ends of the draw band, the draw band being maintained in position over the holes in the panels by the perforations in the front panel prior to the draw band being pulled through the holes for closing the open top of the bag.

* * * * *